US010150019B2

(12) United States Patent
Ines et al.

(10) Patent No.: US 10,150,019 B2
(45) Date of Patent: Dec. 11, 2018

(54) STRIKING FACE DEFLECTION STRUCTURES IN A GOLF CLUB

(71) Applicant: Acushnet Company, Fairhaven, MA (US)

(72) Inventors: Marni Ines, San Marcos, CA (US); Joshua C. Stokes, San Marcos, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 0 days.

(21) Appl. No.: 15/359,206

(22) Filed: Nov. 22, 2016

(65) Prior Publication Data

US 2018/0028879 A1 Feb. 1, 2018

Related U.S. Application Data

(63) Continuation-in-part of application No. 15/220,107, filed on Jul. 26, 2016.

(51) Int. Cl.
*A63B 53/04* (2015.01)
*A63B 53/06* (2015.01)

(52) U.S. Cl.
CPC ..... *A63B 53/047* (2013.01); *A63B 53/0475* (2013.01); *A63B 2053/045* (2013.01); *A63B 2053/0408* (2013.01); *A63B 2053/0416* (2013.01); *A63B 2053/0425* (2013.01); *A63B 2053/0454* (2013.01)

(58) Field of Classification Search
CPC ..... A63B 53/047; A63B 2053/0416; A63B 2053/0408; A63B 2053/045; A63B 2053/0454; A63B 2053/0425; A63B 53/0475
USPC ..... 473/324–350, 287–292
See application file for complete search history.

(56) References Cited

U.S. PATENT DOCUMENTS

| | | | | | |
|---|---|---|---|---|---|
| 1,133,129 | A | | 3/1915 | Govan | |
| 3,817,522 | A | | 6/1974 | Simmons | |
| 4,398,965 | A | | 8/1983 | Campau | |
| 4,754,977 | A | | 7/1988 | Sahm | |
| 4,826,172 | A | | 5/1989 | Antonious | |
| 4,938,470 | A | | 7/1990 | Antonious | |
| 5,121,922 | A | | 6/1992 | Harsh, Sr. | |
| 5,184,823 | A | | 2/1993 | Desboilles | |
| 5,261,664 | A | * | 11/1993 | Anderson | A63B 53/04 473/342 |
| 5,290,032 | A | | 3/1994 | Fenton | |
| 5,328,184 | A | | 7/1994 | Antonious | |
| 5,398,929 | A | * | 3/1995 | Kitaichi | A63B 53/04 473/329 |

(Continued)

*Primary Examiner* — Sebastiano Passaniti

(57) ABSTRACT

A golf club head including a plurality of face support tabs that are attached to an interior surface of the perimeter of a golf club head. The face support tabs are in contact with a rear surface of a striking face and, in some examples, are fastened to the rear surface of the striking face. Where the face support tabs are fastened to the rear surface of the striking face, the edges of the striking face are not directly fastened to the perimeter of the golf club head. Where the face support tabs are not secured to the rear surface of the striking face, the striking face is fastened to the perimeter of the club head body and the face support tabs are preloaded so as to exert a force against the rear surface of the striking face even when the striking face is in a neutral position.

20 Claims, 13 Drawing Sheets

(56) References Cited

U.S. PATENT DOCUMENTS 5,403,007 A * 4/1995 Chen ..... A63B 53/04 473/342
5,464,211 A 11/1995 Atkins, Sr.
5,492,327 A 2/1996 Biafore, Jr.
5,499,814 A 3/1996 Lu
5,505,453 A * 4/1996 Mack ..... A63B 53/04 473/329
5,547,194 A 8/1996 Aizawa
5,669,829 A * 9/1997 Lin ..... A63B 53/04 473/342
5,888,148 A 3/1999 Allen
5,890,973 A 4/1999 Gamble
6,015,354 A 1/2000 Ahn
6,165,081 A 12/2000 Chou
6,299,547 B1 10/2001 Kosmatka
6,299,549 B1 * 10/2001 Shieh ..... A63B 53/04 473/342
6,364,789 B1 * 4/2002 Kosmatka ..... A63B 53/04 473/329
6,595,870 B2 7/2003 Stites
6,695,715 B1 2/2004 Chikaraishi
6,832,961 B2 * 12/2004 Sano ..... A63B 53/0466 473/324
6,855,066 B2 2/2005 Best
6,964,620 B2 * 11/2005 Gilbert ..... A63B 53/04 473/332
6,976,924 B2 * 12/2005 Gilbert ..... A63B 53/04 473/332
6,991,559 B2 1/2006 Yabu
7,056,229 B2 * 6/2006 Chen ..... A63B 53/0466 473/346
7,096,558 B2 * 8/2006 Sano ..... A63B 53/0466 29/34 R
7,160,204 B2 * 1/2007 Huang ..... A63B 53/04 473/342
7,211,006 B2 5/2007 Chang
7,247,104 B2 * 7/2007 Poynor ..... A63B 53/0466 473/329
7,371,190 B2 5/2008 Gilbert
7,559,853 B2 * 7/2009 Hirano ..... A63B 53/0466 473/324
7,575,523 B2 8/2009 Yokota
7,582,024 B2 9/2009 Shear
7,588,503 B2 9/2009 Roach
7,597,633 B2 10/2009 Shimazaki
7,604,550 B1 * 10/2009 Currie ..... A63B 53/047 473/342
7,686,706 B2 * 3/2010 Matsunaga ..... A63B 53/0466 473/329
7,713,141 B2 5/2010 Yamamoto
7,749,100 B2 7/2010 Tavares
7,798,913 B2 9/2010 Noble
7,935,000 B2 5/2011 Stites
8,088,025 B2 1/2012 Wahl
8,157,673 B2 4/2012 Gilbert
8,187,116 B2 5/2012 Boyd
8,210,961 B2 * 7/2012 Finn ..... A63B 53/0466 473/244
8,210,965 B2 * 7/2012 Roach ..... A63B 53/04 473/329
8,267,807 B2 9/2012 Takechi
8,328,663 B2 12/2012 Wahl
8,348,782 B2 * 1/2013 Park ..... A63B 53/047 473/291
8,353,784 B2 * 1/2013 Boyd ..... A63B 53/047 473/334
8,403,771 B1 3/2013 Rice
8,403,774 B2 3/2013 Stites
8,517,863 B2 8/2013 Wahl
8,608,585 B2 12/2013 Stites
8,753,219 B2 6/2014 Gilbert
8,753,228 B2 * 6/2014 Golden ..... A63B 53/0466 473/342
8,758,159 B2 6/2014 Morin
8,814,725 B2 8/2014 Wahl
8,821,307 B2 9/2014 Park
9,265,995 B2 2/2016 Wahl
9,457,241 B2 * 10/2016 Hebreo ..... A63B 60/00
9,597,562 B2 3/2017 Dipert
9,993,704 B2 6/2018 Hebreo
2003/0190975 A1 * 10/2003 Fagot ..... A63B 53/04 473/346
2005/0277485 A1 12/2005 Hou
2007/0026961 A1 2/2007 Hou
2007/0135233 A1 7/2007 Perras
2008/0004131 A1 * 1/2008 Lin ..... A63B 53/04 473/342
2010/0273565 A1 * 10/2010 Stites ..... A63B 53/04 473/282
2011/0250985 A1 10/2011 Stites
2013/0324297 A1 * 12/2013 Larson ..... A63B 53/0466 473/329
2017/0144037 A1 5/2017 Dipert
2018/0028882 A1 2/2018 Hebreo
2018/0028883 A1 2/2018 Morin
2018/0133565 A1 5/2018 Hebreo

* cited by examiner 700
706
708
710
712
714
718
704
730F
730G
730H
730I
7G
7H
7I

STRIKING FACE DEFLECTION STRUCTURES IN A GOLF CLUB

RELATED APPLICATIONS

This application is a continuation-in-part of application Ser. No. 15/220,107, filed Jul. 26, 2016, which is hereby incorporated by reference in its entirety. To the extent appropriate, the present application claims priority to the above-referenced application.

BACKGROUND

It is a goal for golfers to reduce the total number of swings needed to complete a round of golf, thus reducing their total score. To achieve that goal, it is generally desirable for a golfer to have a ball fly a consistent distance when struck by the same golf club and, for some clubs, also to have that ball travel a long distance. For instance, when a golfer slightly mishits a golf ball, the golfer does not want the golf ball to fly a significantly different distance. At the same time, the golfer also does not want to have a significantly reduced overall distance every time the golfer strikes the ball, even when the golfer strikes the ball in the "sweet spot" of the golf club.

SUMMARY

In one aspect, the technology relates to a golf club head that includes a club head perimeter comprising a toe portion, a heel portion, a topline, and a sole portion; a striking face; and a plurality of face support tabs each extending from an interior surface of the club head perimeter towards a rear surface of the striking face. In an example, wherein the plurality of face support tabs includes four separate tabs in contact with the rear surface of the striking face. In another example, the plurality of face support tabs are cantilevered face support tabs secured to the interior surface of the club head perimeter, and each of the plurality of cantilevered face support tabs is in contact with but not secured to the rear surface of the striking face. In yet another example, the plurality of cantilevered face support tabs are pre-loaded such that each of the plurality of cantilevered face support tabs applies pressure against the rear surface of the striking face, when the striking face is in a neutral position. In still yet another example, each of the plurality of cantilevered face support tabs has a thickness of about 1 mm to about 2 mm.

In another example, each of the plurality of face support tabs is secured to the rear surface of the striking face and to the interior surface of the club head perimeter. In yet another example, each of the plurality of face support tabs has a thickness of at least about 3 mm. In still yet another example, the golf club head also includes a gasket disposed between a perimeter of the striking face and the club head perimeter, wherein the perimeter of the striking face is not directly fastened to the club head perimeter. In another example, an angle between each of the plurality of face support tabs and the rear surface of the striking face is less than about 60 degrees.

In another aspect, the technology relates to a golf club head that includes a club head perimeter comprising a toe portion, a heel portion, a topline, and a sole portion; a striking face; and a plurality of cantilevered face support tabs, wherein each of the plurality of cantilevered face support tabs is secured to an interior surface of the club head perimeter and is pre-loaded such that each of the plurality of cantilevered face support tabs applies pressure against a rear surface of the striking face. In an example, a perimeter of the striking face is welded to the club head perimeter. In another example, each of the plurality of cantilevered face support tabs is in contact with the rear surface of the striking face but is not fastened to the rear surface of the striking face. In yet another example, each of the plurality of cantilevered face support tabs has a thickness of about 1 mm to about 2 mm. In still yet another example, an angle between each of the plurality of cantilevered face support tabs and the rear surface of the striking face is less than about 60 degrees. In another example, the plurality of cantilevered face support tabs includes a first cantilevered face support tab at the toe portion, a second cantilevered face support tab at the topline, a third cantilevered face support tab at the heel portion, and a fourth cantilevered face support portion at the sole portion.

In another aspect, the technology relates to a golf club head that includes a club head perimeter comprising a toe portion, a heel portion, a topline, and a sole portion; a striking face; and a plurality of face support tabs, wherein each of the plurality of face support tabs is secured to an interior surface of the club head perimeter and to a rear surface of the striking face, so as to suspend the striking face relative to the club head perimeter. In an example, an angle between each of the plurality of face support tabs and the rear surface of the striking face is less than about 60 degrees. In another example, a perimeter of the striking face is not secured to the club head perimeter. In yet another example, the club head also includes a gasket disposed between the perimeter of the striking face and the club head perimeter. In another example, the plurality of face support tabs includes a first face support tab at the toe portion, a second face support tab at the topline, a third face support tab at the heel portion, and a fourth face support portion at the sole portion.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

The technologies described herein contemplate an iron-type golf club head that incorporates one or more face support elements (e.g., ribs, rods, support structures, etc.) extending towards or proximate to a rear surface of a striking face of the golf club head. By including one or more of those elements, the deflection pattern of the striking face of the golf club can be controlled. In a traditional hollow iron-type golf club, a striking face is attached to a club head such that the striking face has the largest deflection at the geometric center of the striking face. While such a design may lead to large flight distances for a golf ball when struck in the center of the face, any off-center strike of golf ball causes significant changes in flight distance of the golf ball. By incorporating one or more face support elements into the golf club head, the deflection pattern of the striking face can be altered to provide a more consistent ball flight from ball strikes across a larger area of the striking face.

In addition, in traditional hollow iron-type golf club heads, the irregular shape of the golf club face also causes problems with the launch of a golf ball off the club face. For example, a traditional golf club face has a larger surface area towards the toe of the golf club and less surface area towards the heel of the golf club. Due to that shape, deflection of the face upon striking the ball is not symmetric and can cause a golf ball to launch in an undesirable angle. The present technology provides one or more ribs extending from a back portion of the golf club head to the rear surface of the striking face to create a symmetric portion of the striking face. When the symmetric portion of the striking face strikes the golf ball, improved launch characteristics are displayed.

Figure 1A:
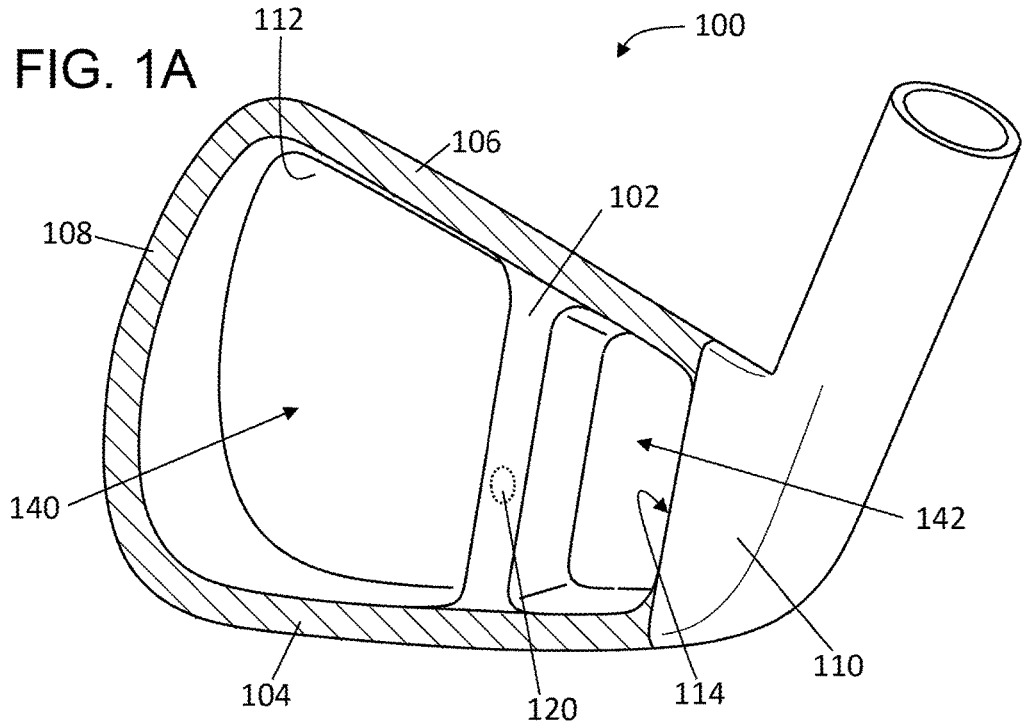
FIGS. 1A-1B depict a partial perspective and a perspective view, respectively, of a golf club head having a rib disposed proximate a center of gravity of the golf club head.
Figure 1B:
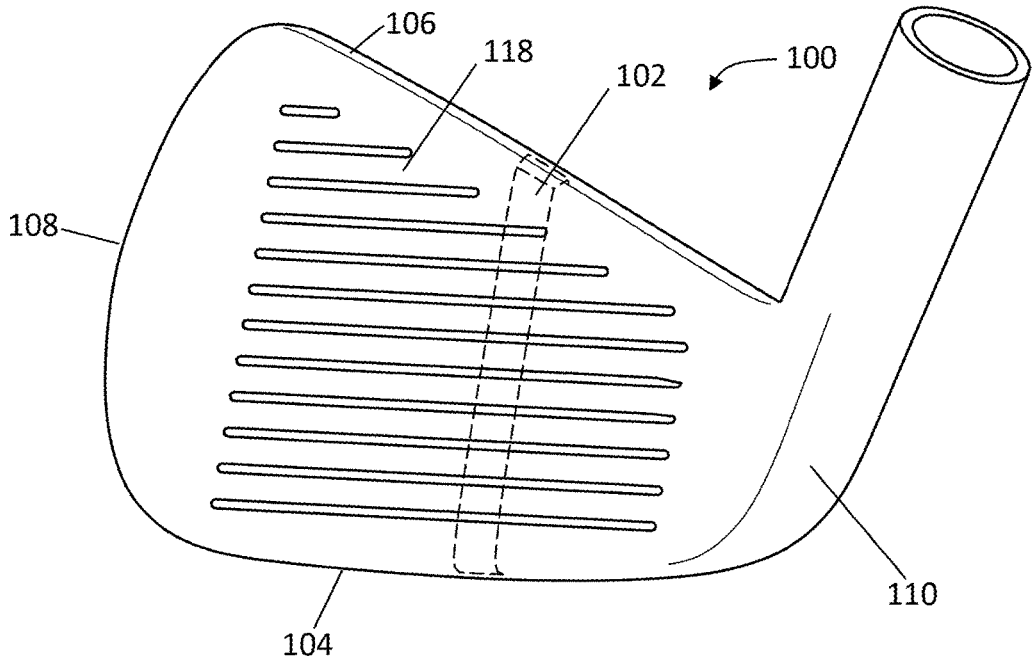

FIGS. 1A-1B depict a perspective view of a golf club head 100 having a rib 102 disposed proximate a center of gravity 120 of the golf club head 100. The golf club head 100 includes a sole portion 104, a topline 106, a toe portion 108, and a heel portion 110, and a back portion 112. The rib 102 extends from the topline 106 to the sole portion 104 at an angle substantially orthogonal to the sole portion 104. The rib 102 also extends from the back portion 112 to a rear surface of a striking face 118, as shown in FIG. 1B. Inclusion of the rib 102 forms two cavities 140, 142. The first cavity 140 is defined by the back portion 112, the toe portion 108, the topline 106, the rib 102, the sole portion 104, and the striking face 118. The second cavity 142 is defined by the back portion 112, the rib 102, the topline 106, the face edge 114 of the heel portion 110, the sole portion 104, and the striking face 118.

The rib 102 may be formed as part of a casting process of the golf club head 100. The rib 102 may also be inserted after the casting process and attached to other components of the golf club head 100 via welding or other attachment methods. For example, the rib 102 may be welded to the back portion 112, the topline 106, and the sole portion 104. In some examples, the rib may also be welded to the rear surface of the striking face 118.

The striking face 118 may also be attached as a single face insert that spans from the toe portion 108 to the heel portion 110. For instance, the striking face 118 may be welded to the sole portion 104, toe portion 108, the topline 106, and a face edge 114 of the heel portion 110. As mentioned above, the striking face 118 may also be welded to the rib 102. In other examples, the striking face 118 may be made of two or more pieces. A first portion of the striking face 118 (disposed over cavity 142) may have first thickness and a second portion of the striking face 118 (disposed over cavity 140) may have a second thickness. In yet other examples, the striking face 118 may be a single face insert having a variable thickness such that the first portion of the striking face 118 over cavity 142 has a first thickness and a second portion of the striking face 118 over cavity 140 has a second thickness.

When a golf ball strikes the striking face 118 at a portion of the striking face 118 backed by the rib 102, the striking face 118 deflects a lesser distance that it would without the rib 102. Because the striking face 118 deflects less when struck at a portion backed by the rib 102, the ball will display a slightly reduced launch velocity than it would if struck by the same club without the rib 102. When a golf ball strikes the striking face 118 at a portion that is backed by one of the two cavities 140, 142, the striking face 118 deflects into the respective cavity. That deflection adds additional launch velocity to the golf ball. The deflection into the respective cavity, however, may still be less than if the club did not have a rib 102. While such a reduction in overall launch velocity may seem undesirable, the slight reduction in launch velocity causes a more consistent launch velocity from strikes made across the entire striking face 118. For instance, a ball strike on the striking face 118 nearest the center of gravity 120 often provides the largest launch velocity for the golf ball. Accordingly, by removing the deflection of the face at the center of gravity 120 by placing a rib 102 at a location of the center of gravity 102, the highest launch velocity is reduced so as to be closer to launch velocities from other portions of the striking face.

Figure 1C:
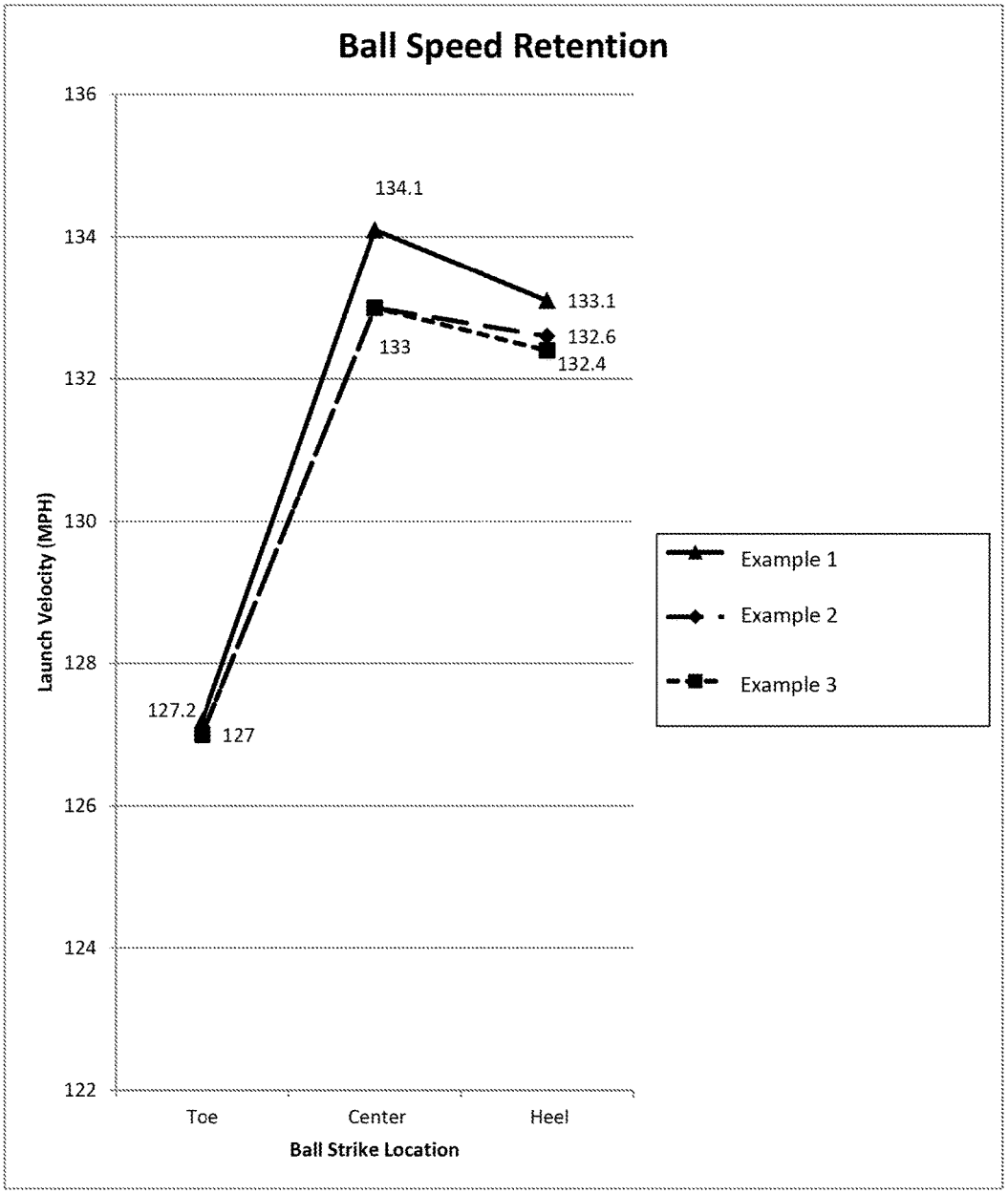
FIG. 1C depicts a plot of launch velocities for golf club heads having a ribs, as compared to a traditional thin face hollow iron.

FIG. 1C depicts a plot of example results of launch velocities for a golf club head 100 having a rib 102 compared to a traditional thin face hollow iron. Launch velocities across the striking face were recorded for multiple example configurations. Example 1 was a baseline hollow iron having a 2.1 mm face thickness. Example 2 was an iron with a multi-thickness face having a rib 102, and the portion of the striking face 118 over the first cavity 140 had a thickness of 1.9 mm and the portion of the striking face 118 over the second cavity 142 had a thickness of 1.7 mm. Example 3 was an iron with a 2.1 mm face thickness also having a rib 102. For Example 1, a ball struck at the center of the face had a about a 134.1 mph launch velocity. A ball struck toward the toe lost about 6.9 mph of launch velocity and a ball struck toward the heel lost about 1.0 mph of launch velocity. For Example 2, a ball struck at the center of the face had a about a 133.0 mph launch velocity, a ball struck toward the toe lost about 6.0 mph of launch velocity, and a ball struck toward the heel lost about 0.4 mph of launch velocity. For Example 3, a ball struck at the center of the face had a about 133.0 mph launch velocity, a ball struck toward the toe lost about 6.0 mph of launch velocity, and a ball struck toward the heel lost about 0.6 mph of launch velocity. Of note, Examples 2 and 3 had the same launch velocity at the center and towards the toe. Thus, the golf club head having a rib 102 slightly reduces the maximum launch velocity, but displays an improved launch velocity retention across the face of the golf club, particularly with a multi-thickness striking face, thus providing greater consistent distance control with that club.

Figure 2:
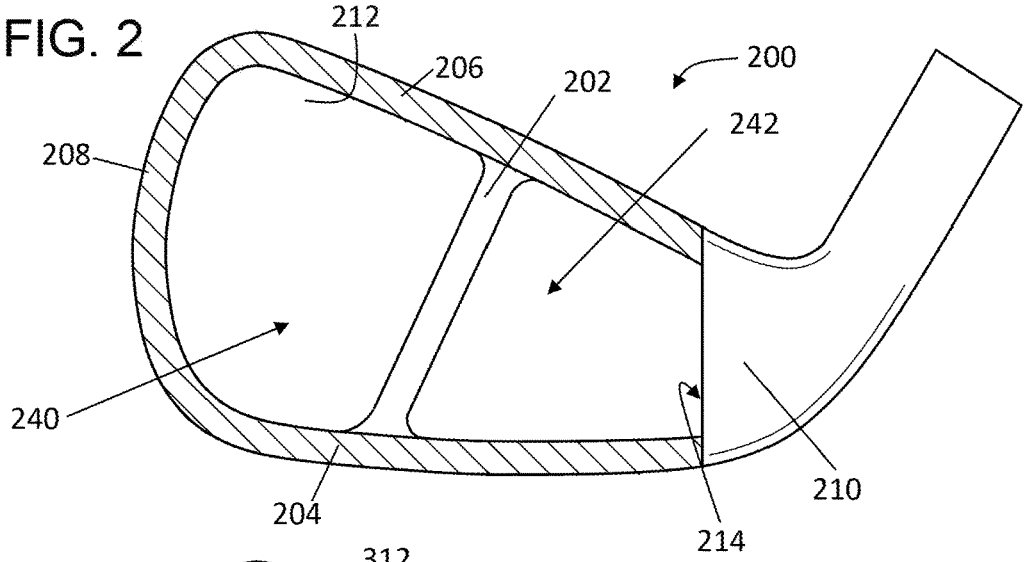
FIG. 2 depicts a partial front view of a golf club head having a rib extending substantially orthogonal to a topline of the golf club head.

FIG. 2 depicts a partial front view of a golf club head 200 having a rib 202 extending substantially orthogonal to the topline 206 of the golf club head 200. Otherwise, the golf club head 200 is substantially similar to the golf club head 100 depicted in FIGS. 1A-1B. The rib 202 may be attached to the back portion 212 and a rear surface of a striking face (not shown). Similar to the golf club head 100, two cavities 240, 242 are formed due to the rib 202. The first cavity 240 is defined at least partially by back portion 212, the toe portion 208, the topline 206, the rib 202, and the sole portion 204. The second cavity 242 is at least partially defined by the back portion 212, rib 202, the topline 206, the face edge 214 of the heel portion 210, and the sole portion 204. A multi-thickness face may also be used with golf club head 200.

Figure 3:
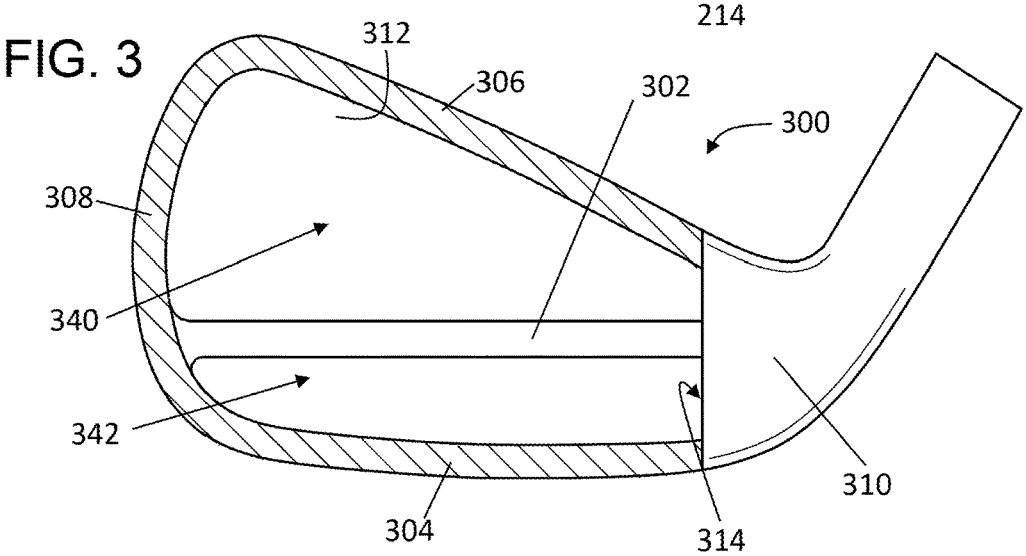
FIG. 3 depicts a partial front view of golf club head having a rib extending substantially orthogonal to a face edge of a heel portion of the golf club head.

FIG. 3 depicts a partial front view of golf club head 300 having a rib 302 extending substantially orthogonal to a face edge 314 of the heel portion 310. Otherwise, the golf club head 300 is substantially similar to the golf club head 100 depicted in FIGS. 1A-1B. When the golf club addresses the ball, the rib 302 may be substantially parallel to the ground. The rib 202 may be attached to the back portion 212 and a rear surface of a striking face. Similar to the golf club head 100 of FIGS. 1A-1B, two cavities 340, 342 are formed due to the rib 302. The first cavity 340 is defined by the back portion 312, toe portion 308, the topline 306, the rib 302, and the face edge 314 of the heel portion 310. The second cavity 342 is defined by the back portion 312, the rib 302, the sole portion 304, the heel portion 310, and the toe portion 308. A single thickness or multi-thickness striking face may also be used with golf club head 300.

Figure 4:
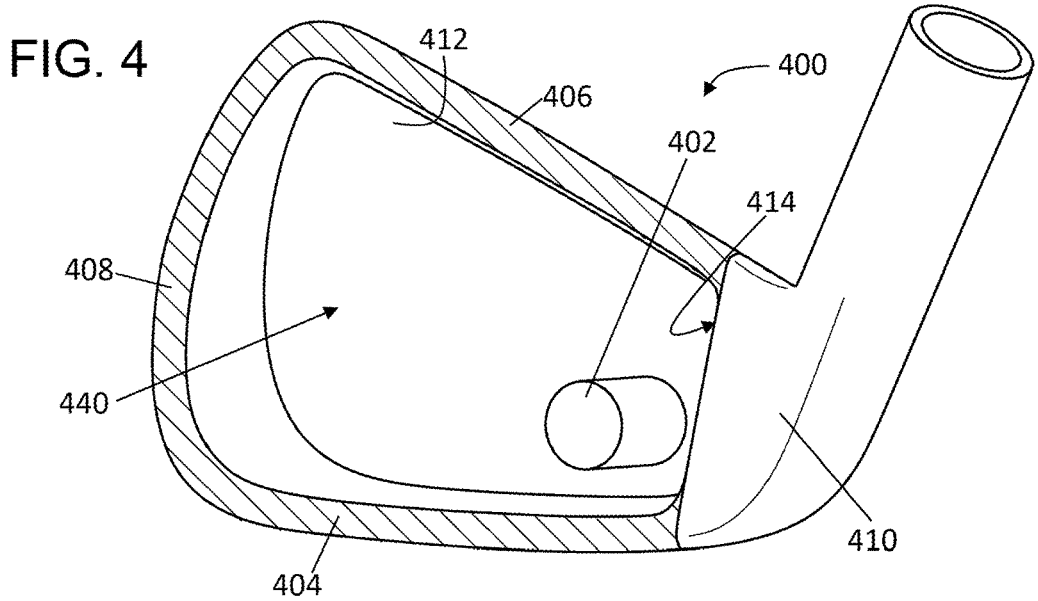
FIG. 4 depicts a partial perspective view of a golf club head having a rod extending from a back portion of the golf club head.

FIG. 4 depicts a perspective view of a golf club head 400 having a cavity 440 with a rod 402 extending from a back portion 412 of the golf club head 400 to a striking face of the golf club head 400. The rod 402 extends from the back portion 412 to the rear surface of the striking face (not shown). Unlike the ribs described above in FIGS. 1-3, the rod 402 is not connected directly to the topline 406, sole portion 404, toe portion 408, or the face edge 414 of the heel portion 410. The rod 402 may also be located at the center of gravity 420 of the golf club head 400. Similar to the ribs discussed above, when a golf ball strikes a portion of the striking face backed by the rod 402, the striking face will have a reduced displacement as compared to a golf club lacking a rod. If the golf ball strikes a portion of the striking face not backed by the rod 402, the striking face will have some displacement, adding to the launch velocity of the golf ball. As such, golf balls that are hit off-center either towards the heel portion 410, toe portion 408, topline 406, or the sole portion 404 will have better distance retention, similar to the results from the rib 102 discussed above with reference to FIG. 1C. For example, in a golf club with a rod 402 having a 15 mm diameter and a striking face with a 2.1 mm thickness, a ball struck at the center of the face had a 132.8 mph launch velocity, and a ball struck toward the toe lost 6.5 mph of launch velocity and a ball struck toward the heel lost 0.4 mph of launch velocity.

Figure 5A:
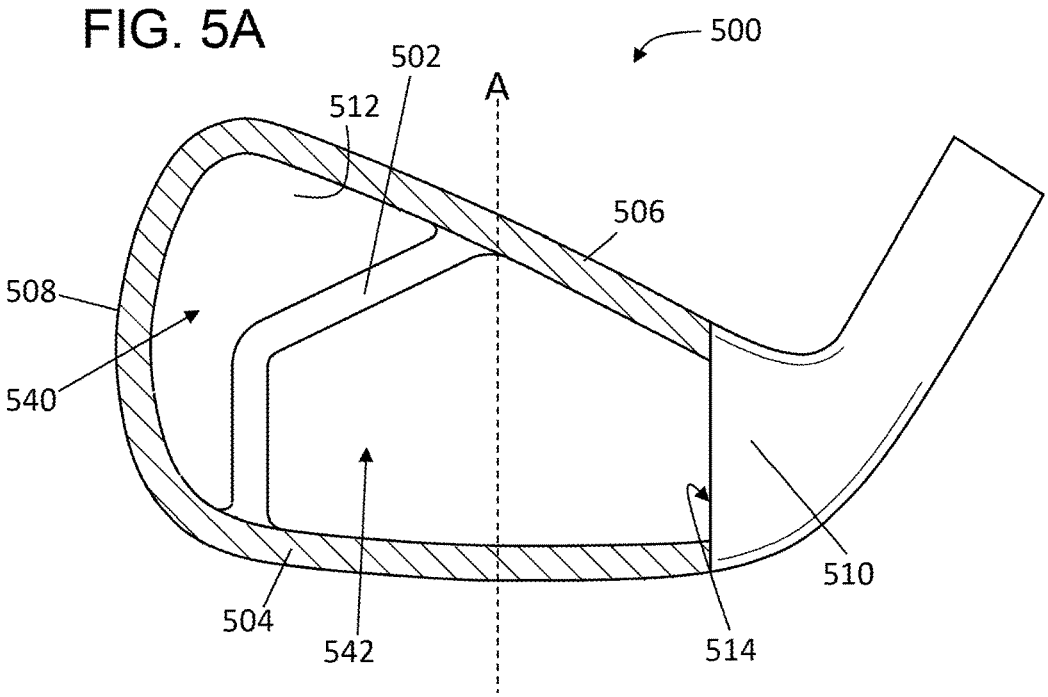
FIG. 5A depicts a partial front view of a golf club head having a rib disposed so as to create a symmetric portion of the striking face.
Figure 5B:
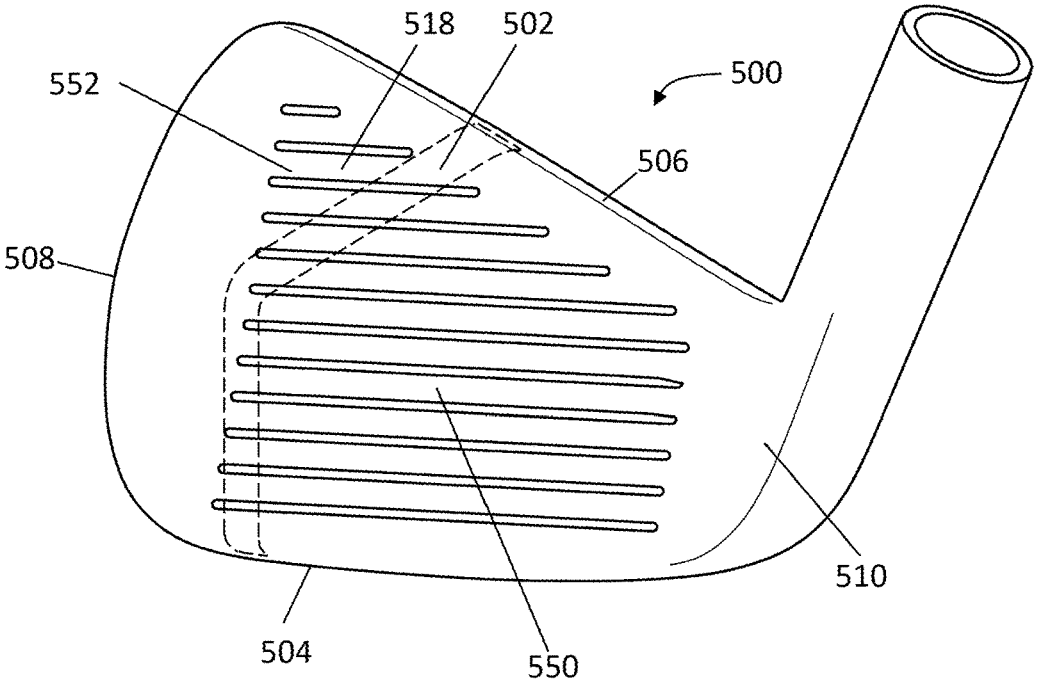
FIG. 5B depicts a perspective view of the golf club head of FIG. 5A having a striking face attached.

FIG. 5A depicts a partial front view of a golf club head 500 having a rib 502 disposed so as to create a symmetric portion 550 of the striking face 518, and FIG. 5B depicts a perspective view of the golf club head 500. The rib 502 extends from the topline 506 to the sole portion 504, and extends from the back portion 512 to a rear surface of the striking face 518. The rib 502, however, does not extend in straight line. Instead, the rib 502 has a shape that substantially mirrors a shape of the topline 506 and the face edge 514 of the heel portion 510. By the rib 502 having such a shape, the striking face 518 has a symmetric portion 550 defined by the portion of the striking face 518 in contact with the topline 506, the sole portion 504, the face edge 514 of the heel portion 510, and the rib 502. The symmetric portion 550 is symmetric about line of symmetry A. The three-dimensions, the symmetric portion 550 is symmetric about a plane orthogonal to a plane defined by the striking face 518. In the example shown in FIGS. 5A-5B, the symmetric portion 550 has an irregular pentagonal shape with two parallel sides, similar to the shape of a home plate. Other potential symmetric shapes may be used.

Two cavities 540, 542 are also formed from inclusion of the rib 502. The first cavity 542 is defined by the back portion 512, the rib 502, the sole portion 504, the topline 506, and the face edge 514 of the heel portion 510. The second cavity is defined by the back portion 512, the rib 502, the sole portion 504, the toe portion 508, and the topline 506.

A multi-thickness-type striking face 518 may also be used with the golf club head 500. For example, the symmetric portion 550 of the striking face 518 may have a first thickness and the non-symmetric portion 552 of the striking face 518 may have a second thickness. The non-symmetric portion 552 of the striking face 518 is defined by contact with the topline 506, the toe portion 508, the sole portion 504, and the rib 502. In some examples, the thickness of the symmetric portion 550 of the striking face 518 may be thicker than the thickness of the non-symmetric portion 552 of the striking face 518. For instance, because the non-symmetric portion 552 is statistically struck less than the symmetric area 550, the non-symmetric portion 552 may be made much thinner than the symmetric portion 550. In an example, the striking face 518 thickness of the non-symmetric portion 552 is less than or equal to about 80% the thickness of the symmetric portion. In some embodiments, the thickness of the non-symmetric portion 552 is between a range of about 0.5 mm to about 1.5 mm. In examples, the range may be about 0.75 mm to about 1.25 mm; or about 0.95 to about 0.05 mm. The striking face 518 may also be formed of two pieces—one piece for the symmetric portion 550 and another piece for the non-symmetric portion 552. In such an example, the symmetric portion 550 of the striking face may be incorporated into both left-handed and right-handed golf clubs without modification.

The different striking face pieces may also be made from different materials. For example, the non-symmetric portion 552 may be made from light-weight materials such as aluminum, titanium, or plastic. In other examples, heavier materials could be used for the non-symmetric portion 552 in order to alter the center of gravity of the golf club head 552. The second cavity 540 may be filled, or partially filled, with a material to alter the center of gravity of the golf club head 500.

By creating a symmetric face portion 550 with inclusion of the rib 502, the launch characteristics of the golf ball may be improved. In a traditional golf club without a rib 502, the striking face is asymmetric due to the striking face being attached only to the perimeter of the golf club. Due to the asymmetry, inconsistent launch conditions occur when the golf balls are struck at various locations along the striking face from the heel to the toe. For example, sidespin, backspin, launch direction, and launch velocity of the golf ball will be inconsistent depending on where on the striking face the ball is struck. With a striking face 518 having a symmetric portion 550, more consistent launch characteristics are displayed across the symmetric portion 550 of the striking face 518.

Figure 6A:
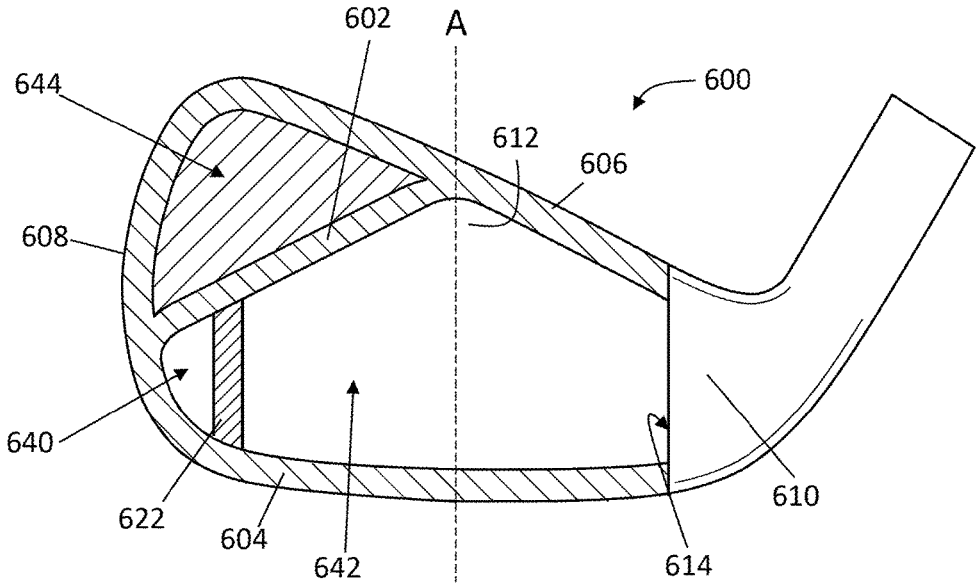
FIG. 6A depicts a partial front view of a golf club head having two ribs disposed so as to create a symmetric portion of the striking face.
Figure 6B:
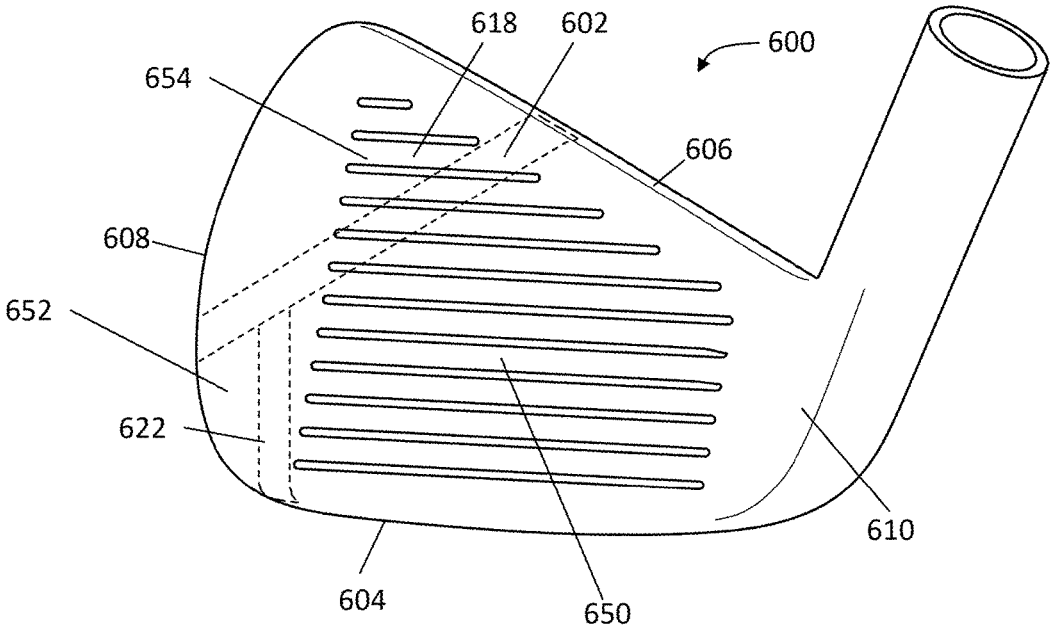
FIG. 6B depicts a perspective view of the golf club head depicted in FIG. 6A.

FIG. 6A depicts a front view of a golf club head 600 having two ribs 602, 622 disposed so as to create a symmetric portion 650 of the striking face 618, and FIG. 6B depicts a perspective view of the golf club head 500. The golf club head 600 includes two ribs 602, 622 rather than a single rib. The first rib 602 extends from the topline 606 to the toe portion 608. The second rib 622 extends from the first rib 602 to the sole portion 604. The first rib 602 and the second rib 622 also extend from the back portion 612 to the rear surface of the striking face 618. In the example depicted in FIGS. 6A-6B, the first rib 602 and the second rib 622 are arranged to substantially mirror a shape of the topline 506 and the face edge 614 of the heel portion 610. By arranging the first rib 602 and the second rib 622 to have such a shape, the striking face 618 has a symmetric portion 650 defined by the portion of the striking face 518 in contact with the topline 606, the sole portion 604, the face edge 614 of the heel portion 610, the first rib 602, and the second rib 622. The symmetric portion 650 is symmetric about line of symmetry A. In the example shown in FIGS. 6A-6B, the symmetric portion 650 has an irregular pentagonal shape with two parallel sides, similar to the shape of a home plate. Other potential symmetric shapes may be used. Further, additional ribs may be incorporated into the golf club head 600 to create other symmetric shapes.

Three cavities are formed in the golf club head 600. The first cavity 642 is formed by the back portion 612, the topline 606, the first rib 602, the second rib 622, the sole portion 604, and the face edge 614 of the heel portion 610. The second cavity 640 is formed by the back portion 612, the first rib 602, the second rib 622, the sole portion 604, and the toe portion 608. The third cavity 644 is formed by the topline 606, the toe portion 608, and the first rib 602. The portion of the striking face 618 backed by the first cavity 642 is the symmetric portion 650 of the striking face 618.

Similar to the golf club head 500 of FIGS. 5A-5B, the golf club head 600 may have a multi-thickness type striking face 618. For example, the symmetric portion 650 of the striking face 618 may have a first thickness. A first non-symmetric portion 652 of the striking face 618 backed by the second cavity 640 may have a second thickness, and a second non-symmetric portion 654 of the striking face 618 backed by the third cavity 644 may have a third thickness. In some examples, the first thickness is greater than the second thickness, and the second thickness is greater than the third thickness. For instance, the second thickness may be less than or equal to about 80% of the thickness of the symmetric portion 650, and the third thickness may be less than or equal to about 50% of the thickness of the symmetric portion 650. In some embodiments, the second thickness and the third thickness is between a range of about 0.5 mm to about 1.5 mm. In examples, the range may be about 0.75 mm to about 1.25 mm; or about 0.95 to about 0.05 mm. In some examples, a section of the back portion 612 behind the third cavity 644 may also be thinner than the remainder of the back portion. The striking face 518 may also be formed of three pieces—a first piece for the symmetric portion 650, a second piece for the first non-symmetric portion 652, and a third piece for the second non-symmetric portion 654. In another example, the striking face 618 may also be formed of two pieces—a first piece for the symmetric portion 650 and the portion backed by the second cavity 640, and a second piece for the portion backed by the third cavity 644. In either the two-piece or three-piece striking face 618 example, the symmetric portion 650 of the striking face may be incorporated into both left-handed and right-handed golf clubs without modification. The symmetric portion 650 of the striking face 618 provides similar launch characteristic benefits as the symmetric portion 550 of the golf club head described in FIGS. 5A-5B.

The different striking face pieces may also be made from different materials. For example, the pieces of the striking faces covering the non-symmetric portions 652, 654 may be made from light-weight materials such as aluminum, titanium, or plastic. In other examples, heavier materials could be used for the pieces of the striking faces covering the non-symmetric portions 652, 654 in order to alter the center of gravity of the golf club head 600. The second cavity 640 and the third cavity 644 may be filled, or partially filled, with a material to alter the center of gravity of the golf club head 600.

Figure 7A:
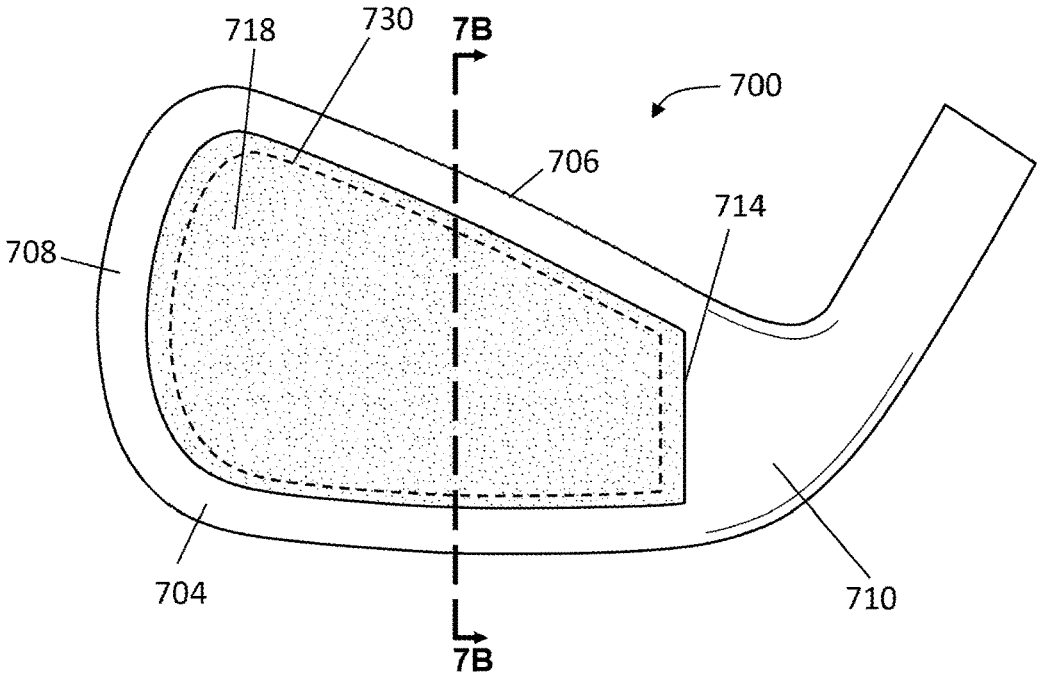
FIG. 7A depicts a front view of a golf club head having a flex support structure.
Figure 7B:
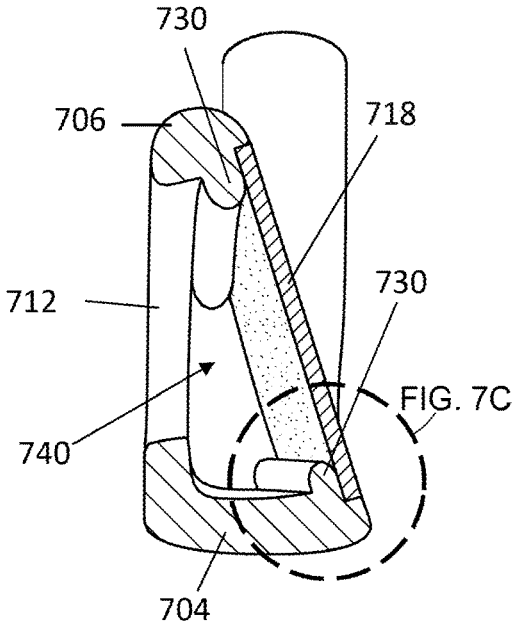
FIG. 7B depicts a section view of the golf club head of FIG. 7A.

FIG. 7A depicts a front view of a golf club head 700 having a flex support structure 730, and FIG. 7B depicts a right sectional view of the golf club head 700 along the section plane indicated in FIG. 7A. The flex support structure 730 is formed around the perimeter of the golf club head 700. In an example, the flex support structure 730 may be formed on or mounted to the topline 706, the toe portion 708, the sole portion 704, and the face edge 714 of the heel portion 710. The flex support structure 730 protrudes or extends into the cavity 740 between the striking face 718 and the back portion 712. In some examples, the flex support structure 730 has a curved surface facing the rear surface of the striking face 718. When the striking face is in non-deflected position (as shown in FIG. 7B), the striking face 718 is not in contact with a portion of the curved surface of the flex support structure. Upon deflection of the striking face 718, such as when striking a golf ball, the rear surface of the striking face 718 contacts more of the curved surface of the flex support structure 730. As the contact area between the striking face 718 and the curved surface of the flex support structure 730 increases (due to greater striking face 718 deflection), the flex support structure 730 provides support to the striking face 718, effectively reducing the span of the striking face 718 more as the striking face 718 deflects further.

By incorporating the flex support structure 730, the thickness of the striking face 718 may be reduced. In traditional golf clubs, the thickness of the striking face may be based on the swing speed of the player. For instance, a thinner striking face may be more useful for players with slower swing speeds because the striking face will deflect more easily, providing higher launch velocities. If a high swing speed player were to use that same club, however, the thin striking face may fail because the striking face would deflect too far. Accordingly, thicker faces are generally required for high swing speed players. Incorporation of the flex support structure 730, however, allows for a single thin striking face 718 to be used for a wide range of swing speeds. At lower swing speeds, the thin striking face 718 will still have almost as much deflection as in a traditional golf club because the minor deflection of the face will not cause much contact with the curved surface of the flex support structure 730. Conversely, at higher swing speeds, the striking face 718 will receive additional support from the flex support structure 730 due to the additional deflection distance. Generally, the height and the rate of curvature of the flex support structure 730 determines the amount of support that the striking face 718 will receive at various deflection depths. While depicted without grooves or scoring lines in FIGS. 7A-7I, the striking face 718 may include such scoring marks as depicted in the striking faces discussed above.

Figure 7C:
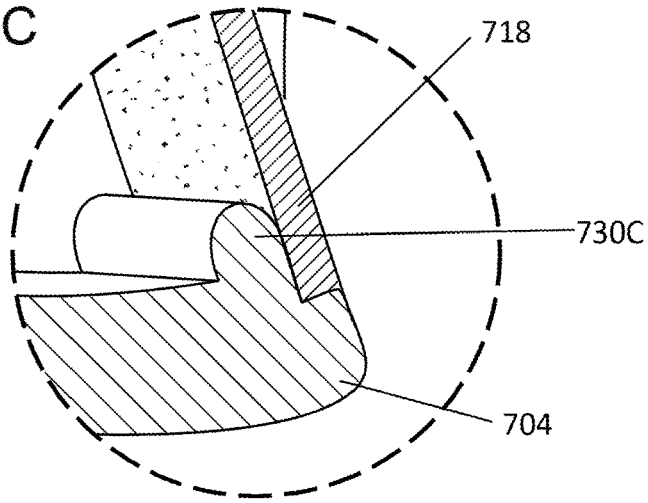
FIGS. 7C-7E depict section views of flex support structures utilized in golf club heads.
Figure 7D:
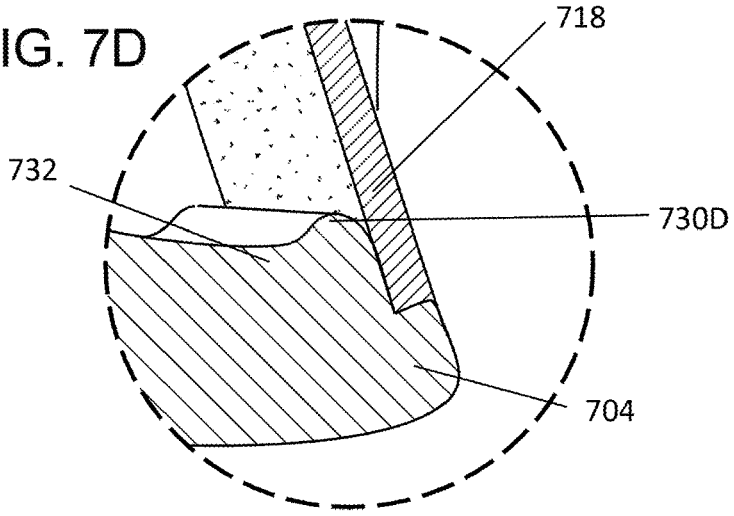
Figure 7E:
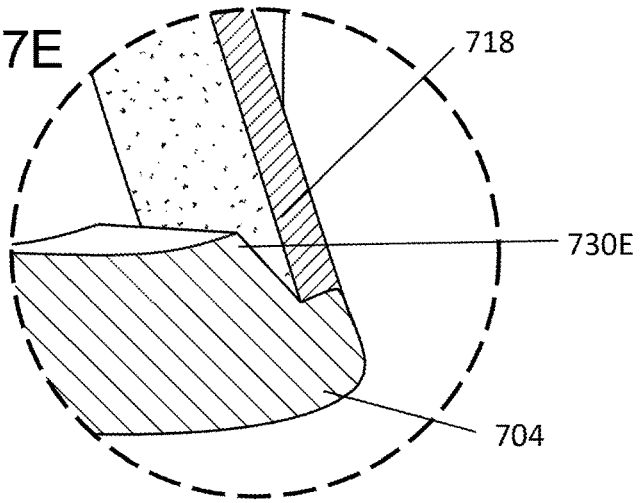

FIGS. 7C-7E depict a right sectional view of different configurations of the flex support structure 730. In an example, the flex support structure 730C has a substantially half-circle shape protruding into the cavity 740. A portion of the flex support structure 730C that is parallel to the striking face 718 may be in contact with the striking face even in a non-deflected position. The curved portion of the flex support structure 730C, however, contacts the striking face 718 only when the striking face is in a deflected position. The further the deflection depth of the striking face 718 into the cavity 740, the greater the area of the curved surface of the flex support structure 730C that will be contacted by the rear surface of the striking face 718. The flex support structure 730D depicted in FIG. 7D has substantially the same height and rate of curvature as the flex support structure 730C. The flex support structure 730D, however, has additional material 732 on the rear side of the flex support structure 730D to provide additional strength to the flex support structure 730C. As discussed, above the rate of curvature or the height of the flex support structure 730C or flex support structure 730D may be modified to adjust the amount of support the striking face 718 receives at various deflection depths.

Flex support structure 730E is an example of a linear flex support structure. The flex support structure 730E includes an angled ramp rather than a curved surface. When the striking face 718 deflects into the cavity 740, the rear surface of the striking face 718 contacts the angled portion of the flex support structure 730E. Similar to the curved flex support structures, the linear flex support structure 730E provides additional support to the striking face 718 as the deflection distance of the striking face increases. The height and angle of the ramped surface may be modified to adjust the amount of support the striking face 718 receives at various depths.

Figures 7F, 7G, 7H, 7I:
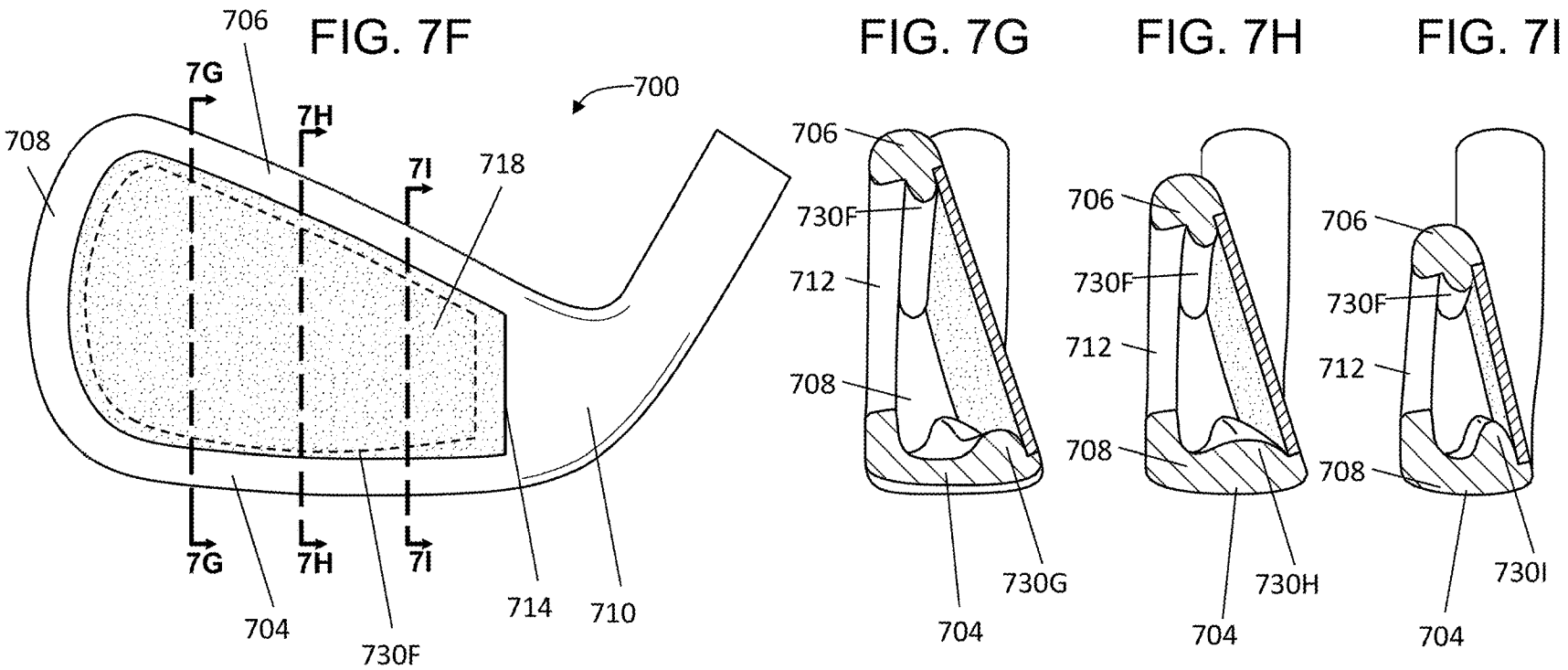
FIG. 7F depicts a front view of a golf club head having a variable flex support structure.
FIGS. 7G-7I depict sections views of the variable flex support structure in the golf club head in FIG. 7F.

FIG. 7F depicts a front view of a golf club head 700F having a variable flex support structure 730F. The variable flex support structure 730F has different heights and/or rates of curvature at different locations between the heel portion 710 and the toe portion 708. Due to the different heights and/or rates of curvature of the variable flex support structure 730F, different portions of the striking face 718 receive different amounts of support when in a deflected position. The different shape characteristics of the variable flex support structure 730F can be seen in the section views shown in FIGS. 7G-7I as indicated by the section plane lines in FIG. 7F.

In the example depicted in FIGS. 7F-7I, the variable flex support structure 730F has a variable profile, such as a variable height and rate of curvature, along the sole portion 704. Towards the toe portion 708, the flex support structure 730G has a first profile defined by a first height and rate of curvature. Closer to the center of the striking face 718, the flex support structure 730H has a second profile with a lower height and a lesser rate of curvature as compared to the profile of flex support structure 730G. Towards the heel portion 710, the flex support structure 730H has a third profile with a height and rate of curvature greater than either the profile of flex support structure 730G or the profile of flex support structure 730H.

In an example, different profiles of the variable flex support structure 730F provide support to the striking face 718 at different deflection depths. For instance, at a first deflection depth of the striking face 718, the rear surface of the striking face 718 may contact the surface of the portions of the variable flex support structure 730F a first profile and the second profile. At a second deflection depth, however, the rear surface of the striking face 718 may only contact the portions of the variable flex support structure 730F having the first profile.

Other configurations are also contemplated. For example, the flex support structure 730H near the center of the club face may have the greatest height compared to the other flex support structures 730G, 730I. In such an example, the center of the striking face 718 has a limited deflection range due to the flex support structure 730H. By limiting the deflection range of the center of the striking face 718, the launch velocity of a golf ball from the center of the striking face 718 is reduced. The shorter flex support structures 730G, 730I towards the toe portion 708 and the heel portion 710 allow for further deflection of the striking face 718, thus contributing to a higher launch velocity. With such a configuration, more even launch velocities across the striking face 718 may achieved, similar to the inclusion of the rib 102 discussed above. The height and rate of curvature of the flex support structure 730F may also be altered or varied along the toe portion 708, the topline 706, and the face edge 714 of the heel to further alter the deflection characteristics of the striking face 718.

In other examples, the variable flex support structure 730H may not extend around the entire perimeter of the cavity 740. For instance, only a section of the sole portion 704 or the topline 706 may have a flex support structure 730H. In another example, the face edge 714 of the heel portion 710 or the toe portion 708 may not have a flex support structure 730H.

Figure 8A:
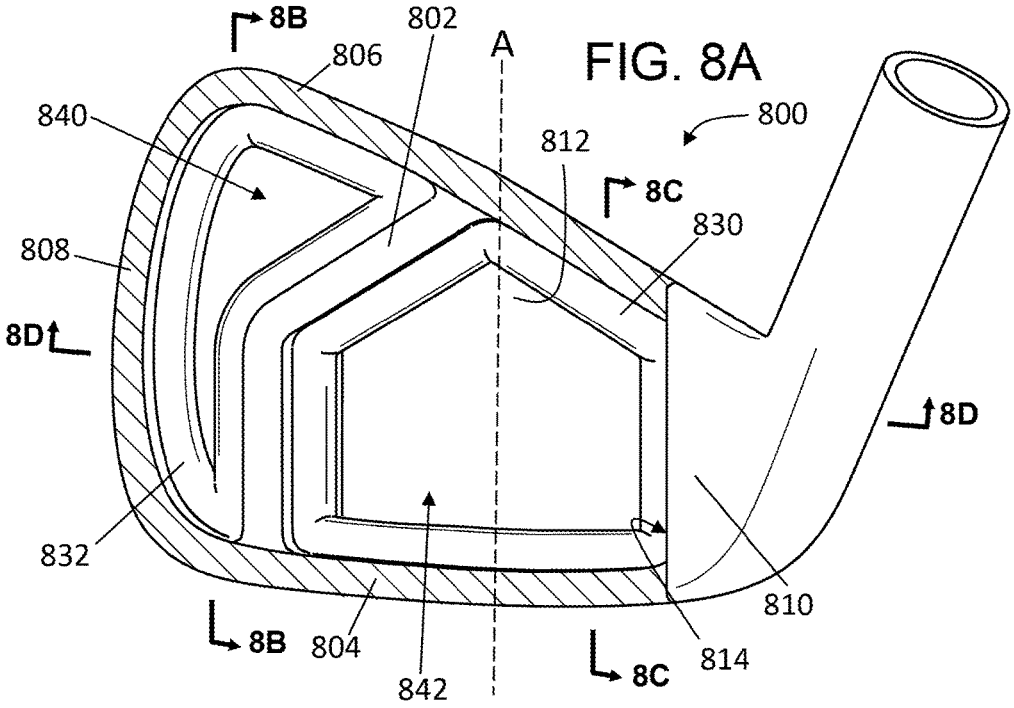
FIG. 8A depicts a golf club head having a flex support structure and a rib disposed so as to create a symmetric portion of the striking face.
Figure 8B:
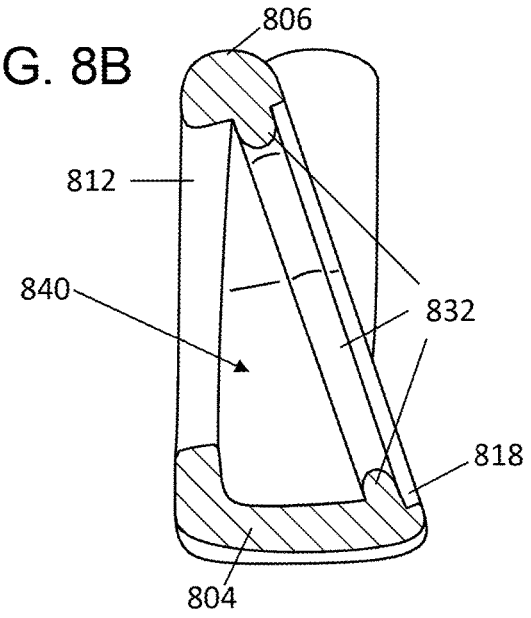
FIGS. 8B-8D depict section views of the golf club depicted in FIG. 8A.
Figure 8C:
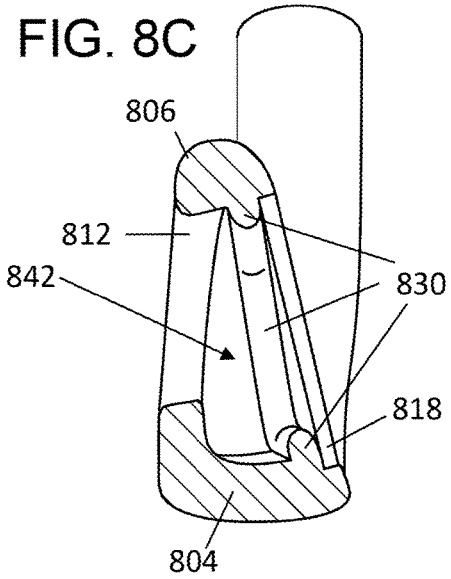
Figure 8D:
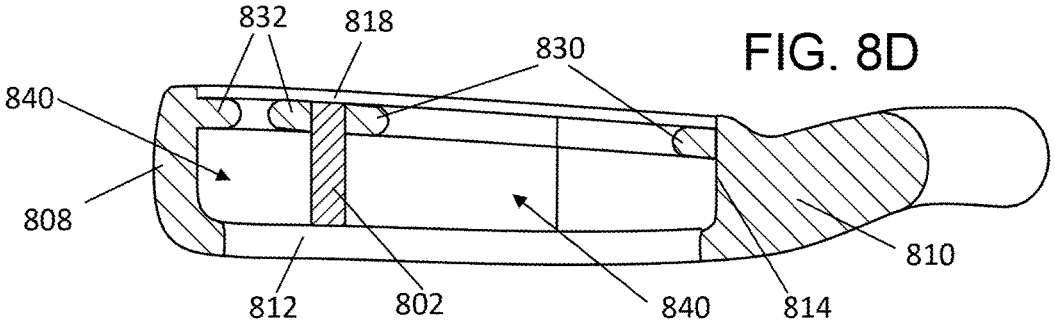

FIG. 8A depicts a golf club head 800 having flex support structures 830, 832 and a rib 802 disposed so as to create a symmetric portion 850 of the striking face 818. FIGS. 8B-8D depict section views of the golf club head 800 as indicated by the section plane lines in FIG. 8A. The rib 802 is similar to the rib 502 discussed above with reference to FIGS. 5A-5B. The rib 802 extends from the back portion 812 to the rear surface of the striking face 818. The rib 802 also extends from the topline 806 to the sole portion 104 and is shaped to substantially mirror a shape of the topline 806 and the face edge 814 of the heel portion 810. By having such a shape, the striking face 818 has a symmetric portion the striking face 818 has a symmetric portion 850 defined by the portion of the striking face 818 in contact with the topline 806, the sole portion 804, the face edge 814 of the heel portion 810, and the rib 802, similar to the symmetric portion 550 described in FIGS. 5A-5B above. A multi-thickness striking face may also be utilized.

The golf club head 800 includes two cavities 840, 842, similar to the two cavities 540, 542 described above in FIGS. 5A-5B. A first flex support structure 830 is attached to the perimeter of the first cavity 840 and a second flex support structure 832 is attached to the perimeter of the second cavity 842. For example, the first flex support structure 830 is attached to or formed on the toe portion 808, the sole portion 804, the toe-side surface of the rib 802, and the topline 806. The second flex support structure 832 is attached to or formed on the topline 806, the heel-side surface of the rib 802, the sole portion 804, and the face edge 814 of the heel 810 portion. The first flex support structure 830 protrudes or extends into the first cavity 840 and the second flex support structure 832 protrudes into the second cavity. Similar to the flex support structures discussed above with reference to FIGS. 7A-7I, the flex support structures 830, 832 provide additional support for the striking face 818 when in a deflected position. For instance, where the symmetric portion of the striking face 818 deflects, the rear surface of the striking face 818 will contact a portion of the curved surfaces of second flex support structure 832. If the non-symmetric portion of the striking face 818 deflects, the rear surface of the striking face 818 will contact a portion of the curved surfaces of the first flex support structure 830. In some embodiments, the golf club head 800 does not include the second flex support structure 832.

The first flex support structure 830 and/or the second flex support structure 832 may also be a variable flex support structure similar to the variable flex support structure 730H discussed above with reference to FIGS. 7F-7I. For example, the profile of the flex support structure 832 may change around the perimeter of the second cavity 842, e.g., the height of the flex support structure 832 may be greater near the line of symmetry A to reduce the deflection of the striking face 818 at that point where maximum deflection would occur. By having the flex support structure 832 have a greater height near the line of symmetry, more consistent launch velocities may be achieved across the symmetric portion of the striking face.

The flex support structures 830, 832 may be incorporated into a golf club head having any of the rib or rod structures discussed above along with other structures that may be incorporated into a golf club head.

Figure 9A:
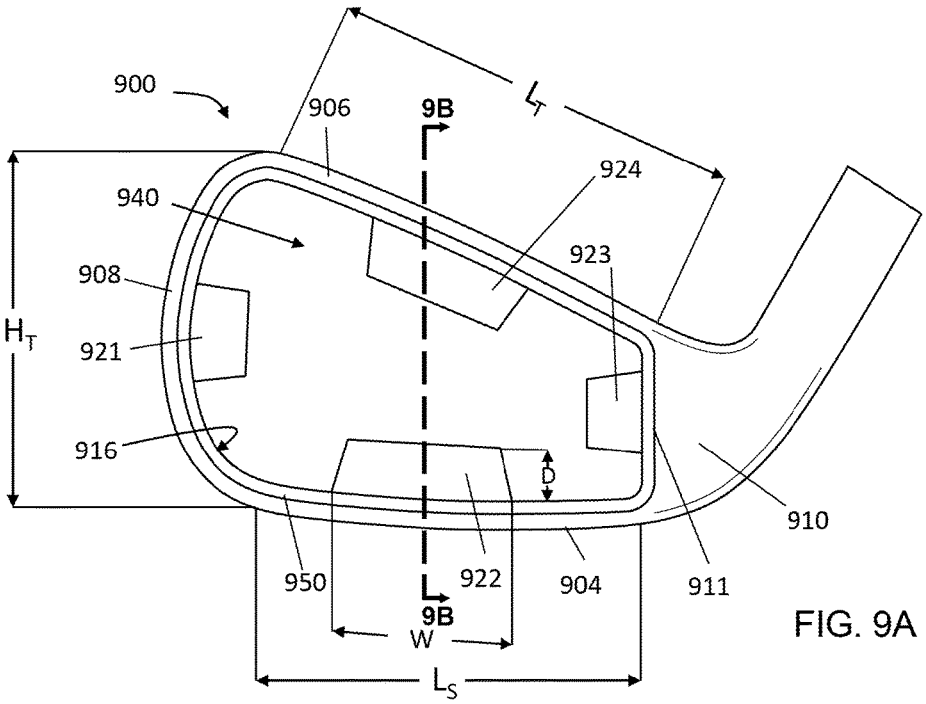
FIG. 9A depicts a front view of a golf club head having a plurality of preloaded cantilevered tabs.
Figure 9B:
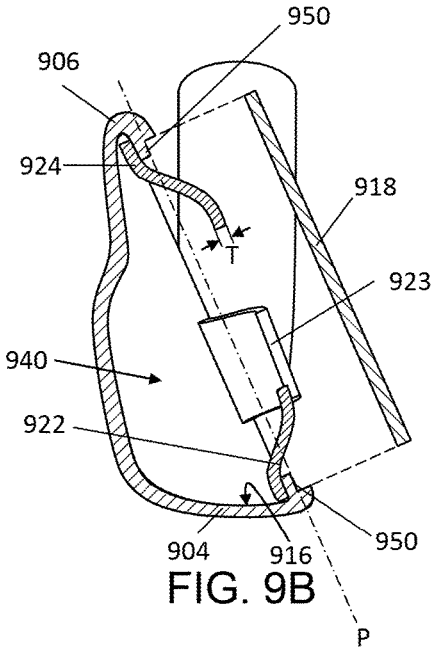
FIG. 9B depicts a right sectional view of the golf club head depicted in FIG. 9A prior to attachment of a striking face.
Figure 9C:
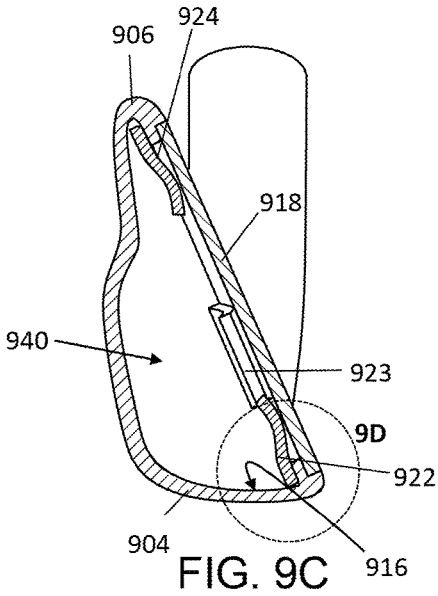
FIG. 9C depicts a right sectional view of the golf club head depicted in FIGS. 9A-9B after attachment of the striking face.
Figure 9D:
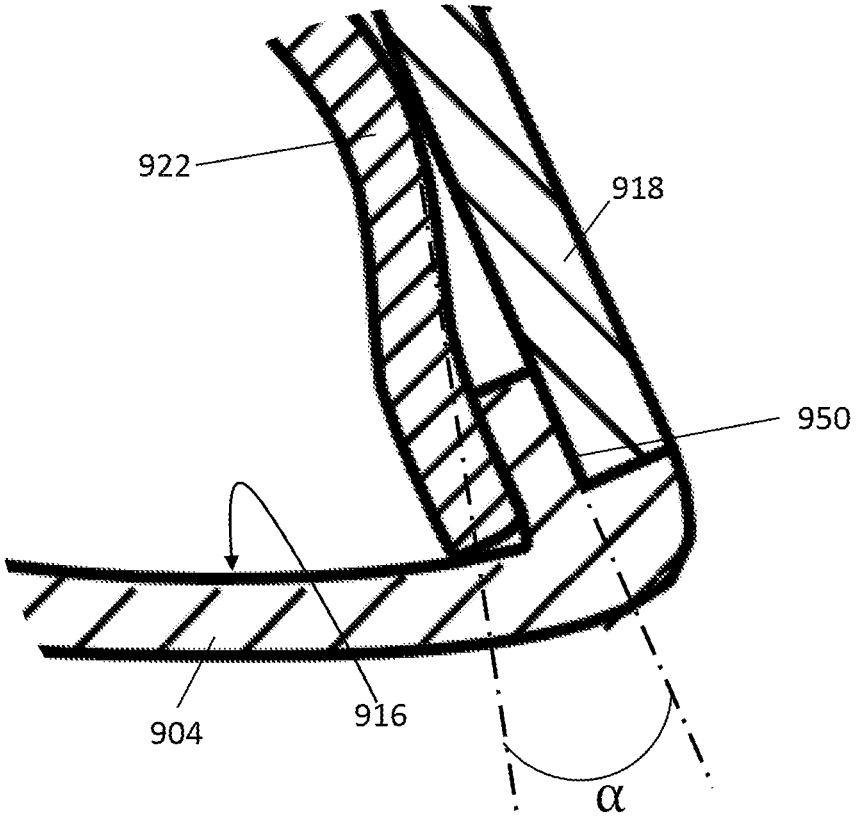
FIG. 9D depicts an enlarged view of a portion of the golf club head 900 as indicated in FIG. 9C.

FIG. 9A depicts a front view of a golf club head 900 having a plurality of preloaded, cantilevered face support tabs 921-924. FIG. 9B depicts a right sectional view of the golf club head 900 along the section plane indicated in FIG. 9A prior to attachment of a striking face 918, and FIG. 9C depicts the right sectional view of FIG. 9B but with the striking face 918 attached to the golf club head 900. FIG. 9D depicts an enlarged view of a portion of the golf club head 900 as indicated in FIG. 9C. Club head 900 has a topline 906, a toe portion 908, a sole portion 904, and a heel portion 910, which in combination define a perimeter of the golf club head 900. A plurality of face support tabs 921-924 are attached at one end to an interior surface 916 of the perimeter of the golf club head 900. The other end of the tabs 921-924 is in contact with a rear surface of the striking face 918, but are not attached or otherwise secured to the rear surface of the striking face 918. In some examples, the tabs 921-924 may be formed during a casting process of the club head body or may be attached to the interior perimeter surface after casting via welding or other fastening procedures or mechanisms. In the particular example depicted in FIGS. 9A-9B, the plurality of tabs 921-924 includes a toe tab 921 at the toe portion 908, a sole tab 922 at the sole 904, a heel tab 923 at the heel 910, and a topline tab 924 at the topline 906. In other examples, a greater or fewer number of tabs may be implemented.

Prior to the striking face 918 being attached to the club head 900, one or more of the tabs 921-924 extend from the interior surface 916 of the perimeter to a point beyond the shelf plane P, as shown in FIG. 9B. The shelf plane P is the plane on which the rear surface of the striking face 918 rests upon being attached to the golf club head 900, and the shelf plane P may further be defined by a shelf 950 that is formed along at least a portion of the perimeter of the golf club head 900. The striking face 918 is then attached, thus bending the cantilevered tabs 921-924 into the cavity 940. In an example, the striking face 918 may be clamped into place and then welded to the perimeter of the club head 900. Once the striking face 918 has been welded to the perimeter the golf club head 900, the cantilevered tabs 921-924 apply a pressure against the rear surface of the striking face 918 when the striking face 918 is in a neutral position, e.g., when not striking a golf ball or rebounding from striking a golf ball. Accordingly, the cantilevered tabs 921-924 are preloaded against the striking face 918. By preloading the cantilevered tabs 921-924 against the striking face, a thinner striking face 918 can be incorporated into the golf club head 900. For example, the striking face 918 may have a thickness within the ranges of about 1-3 mm, 1.5-2.5 mm, 1.0-2.0 mm, and 1.5-2.0 mm. The preloading of the cantilevered tabs 921-924 also affects launch characteristics of golf ball upon impact with the striking face 918. In some examples, the club head 900 displays a coefficient of restitution (COR) within the ranges of 0.8-0.83 and 0.81-0.82.

Each of the preloaded cantilevered tabs 921-924 may have the same or different dimensions. Each of the tabs 921-924 may be characterized by its width W, its depth D into the cavity, the thickness T of the tab, and the angle $\alpha$ between the respective tab and the rear surface of the striking face 918 when the striking is attached to the club head 900. The width W of the sole tab 922 may have a variety of possible dimensions depending on the particular application. For example, the width W of the sole tab 922 may be between approximately one-half (½) to three-quarters (¾) the Length $L_S$ of the sole portion 904, or less. In other examples, the width W of the sole tab 922 may be between approximately 0.2-1.5 inches, 0.4-0.8 inches, 0.75-1.25 inches, or 1.0-1.5 inches. The thickness T of the sole tab 922 may be between the ranges of about 1.0-2.0 mm, 1.2-1.8 mm, or 1.4-1.6 mm. The angle $\alpha$ for the sole tab 922 may be between 45-60 degrees, less than 45 degrees, or less than 20 degrees. The thickness of the sole tab 922 may be between approximately 0.5-2.0 mm, 0.8-1.5 mm, or 0.8-1.2 mm. The depth D of the sole tab 922 may be between approximately 4.0-12.0 mm, 5.0-10.0 mm, or 7.0-8.0 mm. The dimensions of each of the tabs may also depend on of the thickness of the striking face 918. For instance, for thinner striking faces, the depth D and/or width W of one or more of the tabs 921-924 are generally larger. In some examples, the ratio of the width W of the sole tab 922 to the thickness of the striking face 918 may be between about 8:1 to 20:1, 10:1 to 18:1, or 12:1 to 16:1. The portion of the sole tab 922 attached to the interior perimeter surface may be centered at the midpoint of the sole. In other examples, the portion of the sole tab 922 attached to the interior perimeter surface may be centered below a center of gravity for the golf club head 900.

The other tabs may have similar dimensions as the sole tab 922. For instance, the topline tab 924 may have substantially the same or similar dimensions at the sole tab 922. In some examples, however, the dimensions of the topline tab 924 may be described relative to the length $L_T$ of the topline 906. For instance, the length $L_T$ of the topline tab 924 may be between approximately one-half (½) to three-quarters (¾) the width of the topline 906. The portion of the topline tab 924 attached to the interior perimeter surface may be centered on the midpoint of the topline 906. In other examples, the portion of the topline tab 924 attached to the interior perimeter surface may be centered above the center of gravity for the golf club head 900. The depth D, angle α, and the thickness T of the topline tab 924 may be within the same ranges as discussed above for the corresponding dimensions of the sole tab 922. In some examples, however, while the depth D, angle α, and the thickness T of the topline tab 924 may be within the same ranges discussed above, the topline tab 924 may not have the same dimensions as sole tab 922.

In some of the examples, the toe tab 921 may have a width equal to one-half (½) to three-quarters (¾) the height $H_T$ of the toe portion 908. The portion of the toe tab 921 attached to the interior perimeter surface may be centered on the midpoint of the toe portion 908. In other examples, the portion of the topline tab 924 attached to the interior perimeter surface may be centered at a height of the center of gravity for the golf club head 900. The depth D, angle α, and the thickness T of the toe tab 921 may be within the same ranges as discussed above for the corresponding dimensions of the sole tab 922. In some examples, however, while the depth D, angle α, and the thickness T of the toe tab 921 may be within the same ranges discussed above, the toe tab 921 may not have the same dimensions as sole tab 922 or the topline tab 924.

The heel tab 923 may have a width equal to one-half (½) to three-quarters (¾) the height of the heel edge 911, or larger. The portion of the heel tab 923 attached to the interior perimeter surface may be centered on the midpoint of the heel edge 911. In other examples, the portion of the topline tab 924 attached to the interior perimeter surface may be centered at a height of the center of gravity for the golf club head 900. The depth D, angle α, and the thickness T of the heel tab 923 may be within the same ranges as discussed above for the corresponding dimensions of the sole tab 922. In some examples, however, while the depth D, angle α, and the thickness T of the heel tab 923 may be within the same ranges discussed above, the heel tab 923 may not have the same dimensions as sole tab 922, the topline tab 924, or the toe tab 921.

Figure 10A:
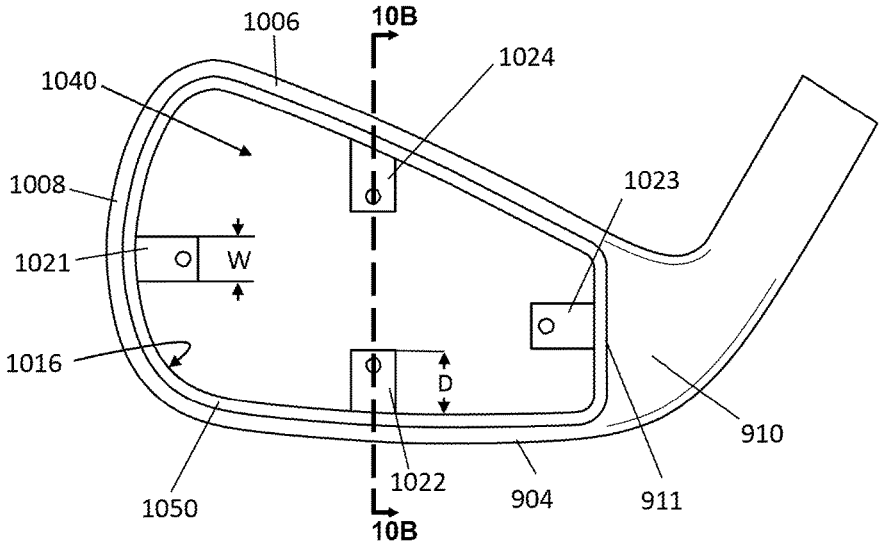
FIG. 10A depicts a front view of a golf club head having a striking face with edges that can flex at least partially free from the perimeter of the golf club head.
Figure 10B:
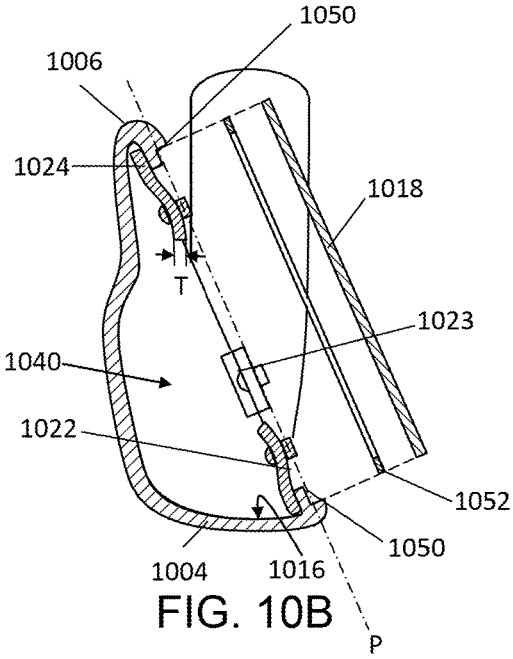
FIG. 10B depicts a right sectional view of the golf club head depicted in FIG. 10A.
Figure 10C:
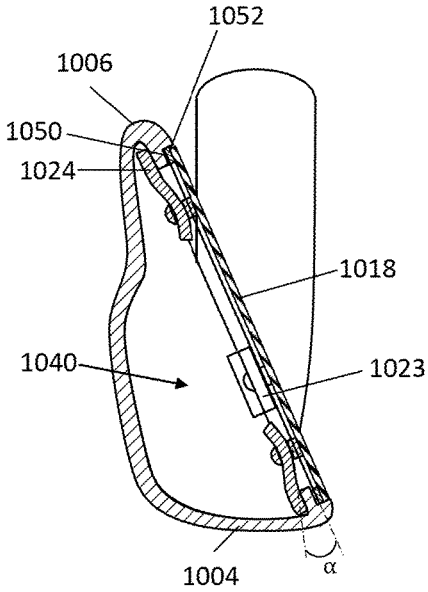
FIG. 10C depicts the right sectional view of FIGS. 10A-10B after attachment of the striking face.

FIG. 10A depicts a front view of a golf club head 1000 having a striking face 1018 with edges that can flex at least partially free from the perimeter of the golf club head 1000. FIG. 10B depicts a right sectional view of the golf club head 1000 depicted in FIG. 10A along the section plane indicated in FIG. 10A prior to attachment of a striking face 1018. FIG. 10C depicts the right sectional view of FIG. 10B but with the striking face 1018 attached to the golf club head 1000. The golf club head 1000 differs from golf club head 900 in that the striking face 1018 is secured directly to each of the face support tabs 1021-1024. Further, the striking face 1018 is not directly fastened to the perimeter of the golf club head 1000. As such, the edges of the striking face 1018 are able to move outward from the remainder of the club head 1000 upon impacting a golf ball. In some examples, a gasket 1052 is placed between the perimeter of the golf club head 1000 and the striking face 1018 to prevent debris from entering a cavity 1040 or excessive wear between the surfaces of the striking face 1018 and the surfaces of the perimeter of the club head 1000.

The golf club head 1000 includes a topline 1006, a toe portion 1008, a sole portion 1004, and a heel portion 1010, which in combination define a perimeter of the golf club head 1000. The golf club head 1000 also includes a plurality of tabs 1021-1024. As an example, the golf club head 1000 may include a toe tab 1021, a sole tab 1022, a heel tab 1023, and a top-line tab 1024. The tabs 1021-1024 may be formed during a casting process of the club head body or may be attached to the interior perimeter surface after casting. In some examples, each of the tabs 1021-1024 are secured to both an interior surface 1016 of the perimeter of the golf club head 1000 and to the rear surface of the striking face 1018. Securing the tabs 1021-1024 to the interior surface 1016 of the perimeter and to the rear surface of the striking face may be accomplished via welding, rivets, screws, or other fastening or securing techniques. In other examples, fewer that all of the plurality of tabs 1021-1024 are attached to the rear surface of the striking face 1018. For instance, two of the tabs may be attached only to the interior surface 1016 of the perimeter, whereas the remaining two tabs are attached to both the interior surface 1016 of the perimeter and the rear surface of the striking face 1018.

Because the plurality of tabs 1021-1024 support the striking face 1018 that is otherwise not secured to the perimeter of the golf club head 1000, the plurality of tabs 1021-1024 are generally more robust than the plurality of tabs 921-924 discussed above with reference to FIGS. 9A-9C. For instance, because the edges of the striking face 1018 are not fastened to the perimeter of the golf club head 1000, the tabs 1021-1024 provide the majority of support for the striking face 1018 upon striking a golf ball. Thus, the configuration of the tabs 1021-1024 must provide enough support to withstand the forces generated upon such a ball strike. As an example, the thickness T of the tabs 1021-1024 may be greater than the thickness T of the tabs 921-924. For instance, the thickness T of each of the tabs 1021-1024 may be about 3 mm or between 2-6 mm, 3-5 mm, 3-4 mm, or at least 3 mm. Each of the tabs 1021-1024 may or may not have the same thickness T. Further, in some examples, because the striking face 1018 is not directly secured to the perimeter of the golf club head 1000, the striking face 1018 is also thicker than the striking face 918 described above with reference to FIGS. 9A-9C. For instance, the striking face 1018 may have a thickness of 1.5 mm-2.5 mm or 2.0 mm-3.0 mm, or greater than 3.0 mm.

In some examples, the other dimensions of the tabs 1021-1024 may be the same or similar to the dimensions of the tabs 921-924 described above with reference to FIGS. 9A-9C. The end of each tab 1021-1024 attached to the rear surface of the striking face 1018, however, should be positioned such that the front surface of the striking face 1018 is flush with the perimeter of the golf club head 1000 when attached. For instance, the angle α and the depth D of each tab 1021-1024 should have values such that the portion of each tab 1021-1024 results in the front surface of the striking face 1018 being flush with the perimeter of the golf club head 1000. In other examples, the depth D and angle α of one or more of the tabs 1021-1024 is configured such that the portion of the tab to be connected to the rear surface of the striking face 1018 is slightly behind the shelf plane P. For instance, the portion of the tab to be connected to the rear of the striking face 1018 may be between about 0.3-1.0 mm behind the shelf plane P. In such examples, the tabs may be biased forward to attach the striking face 1018. Thus, when the striking face 1018 is attached to the tabs 1021-1024, a spring force of the tabs 1021-1024 pulls the striking face 1018 towards the cavity 1040. Thus, in that example, the edges of the striking face 1018 exert a small force against the gasket 1052 or shelf 1050 to hold the striking face 1018 in place, but still allow the striking face 1018 to flex upon striking a golf ball.

The widths W, depths D, and angles α for each of the tabs 1021-1024 may be the same or similar to the widths W, depths D, and angles α for the respective tabs 921-924 described above with reference to FIGS. 9A-9C.

Although specific embodiments and aspects were described herein and specific examples were provided, the scope of the invention is not limited to those specific embodiments and examples. One skilled in the art will recognize other embodiments or improvements that are within the scope and spirit of the present invention. Therefore, the specific structure, acts, or media are disclosed only as illustrative embodiments. The scope of the invention is defined by the following claims and any equivalents therein.

The invention claimed is:

1. A golf club head comprising:

a club head perimeter comprising a toe portion, a heel portion, a topline, and a sole portion;

a shelf defined by an interior of the club head perimeter;

a striking face having a rear surface resting on the shelf; and a plurality of face support tabs including:

a first pre-loaded face support tab extending from a first position of an interior surface of the club head perimeter adjacent the shelf and towards the rear surface of the striking face at an angle of less than about 60 degrees, wherein the first position is offset from the shelf; and a second pre-loaded face support tab extending from a second position of the interior surface of the club head perimeter adjacent the shelf and towards the rear surface of the striking face at an angle of less than about 60 degrees, wherein the second position is offset from the shelf.

2. The golf club head of claim 1, wherein the plurality of face support tabs further includes a third face support tab and a fourth face support tab, wherein each of the face support tabs is in contact with the rear surface of the striking face.

3. The golf club head of claim 1, wherein the plurality of face support tabs are cantilevered face support tabs secured to the interior surface of the club head perimeter, and wherein each of the plurality of cantilevered face support tabs is in contact with but not secured to the rear surface of the striking face.

4. The golf club head of claim 3, wherein each of the plurality of cantilevered face support tabs has a thickness of about 1 mm to about 2 mm.

5. The golf club head of claim 1, wherein each of the plurality of face support tabs is secured to the rear surface of the striking face and to the interior surface of the club head perimeter.

6. The golf club head of claim 5, wherein each of the plurality of face support tabs has a thickness of at least about 3 mm.

7. The golf club head of claim 5, further comprising a gasket disposed between a perimeter of the striking face and the club head perimeter, wherein the perimeter of the striking face is not directly fastened to the club head perimeter.

8. The golf club head of claim 1, wherein the angle between the first face support tab and the rear surface of the striking face is between about 45 degrees to 60 degrees.

9. A golf club head comprising:

a club head perimeter comprising a toe portion, a heel portion, a topline, and a sole portion;

a striking face having a rear surface resting against an interior surface of the club head perimeter; and a plurality of cantilevered face support tabs, wherein each of the plurality of cantilevered face support tabs is secured to and extends from a position adjacent to and offset from the interior surface to the rear surface of the striking face at an angle less than about 60 degrees, wherein each of the plurality of cantilevered face support tabs is not secured to the striking face and is pre-loaded such that each of the plurality of cantilevered face support tabs applies pressure against the rear surface of the striking face, wherein each of the plurality of cantilevered face support tabs contacts the rear surface of the striking face at a different location.

10. The golf club head of claim 9, wherein a perimeter of the striking face is welded to the club head perimeter.

11. The golf club head of claim 10, wherein each of the plurality of cantilevered face support tabs is in contact with the rear surface of the striking face but is not fastened to the rear surface of the striking face.

12. The golf club head of claim 9, wherein each of the plurality of cantilevered face support tabs has a thickness of about 1 mm to about 2 mm.

13. The golf club head of claim 9, wherein the angle is between about 45 degrees to 60 degrees.

14. The golf club head of claim 9, wherein the plurality of cantilevered face support tabs includes:

a first cantilevered face support tab at the toe portion, the first cantilevered face support tab having a width between about one-half to three-quarters of a height of the toe portion;

a second cantilevered face support tab at the topline, the second cantilevered face support tab having a width between about one-half to three-quarters a length of the topline;

a third cantilevered face support tab at the heel portion, the third cantilevered face support tab having a width between about one-half to three-quarters a height of a heel edge of the heel portion; and a fourth cantilevered face support tab at the sole portion, the fourth cantilevered face support tab having a width between about one-half to three-quarters a length of the sole portion.

15. A golf club head comprising:

a club head perimeter comprising a toe portion, a heel portion, a topline, and a sole portion;

a shelf defined by an interior surface of the club head perimeter;

a striking face having a rear surface resting on the shelf; and a plurality of face support tabs, wherein each of the plurality of face support tabs is secured to a position adjacent to and offset from the shelf on the interior surface of the club head perimeter and to the rear surface of the striking face, so as to suspend the striking face relative to the club head perimeter, wherein the tab extends from the offset position to the rear surface of the striking face at an angle less than about 60 degrees.

16. The golf club head of claim 15, wherein the angle is between about 45 degrees to 60 degrees.

17. The golf club head of claim 15, wherein a perimeter of the striking face is not secured to the club head perimeter.

18. The golf club head of claim 17, further comprising a gasket disposed between the perimeter of the striking face and the club head perimeter.

19. The golf club head of claim 15, wherein the plurality of face support tabs includes a first face support tab at the toe portion, a second face support tab at the topline, a third face support tab at the heel portion, and a fourth face support portion at the sole portion.

20. The golf club head of claim 15, wherein a thickness of each of the plurality of face support tabs is between 2-6 mm.

* * * * *